US006041532A

United States Patent [19]

Pollhaus et al.

[11] Patent Number: 6,041,532

[45] Date of Patent: Mar. 28, 2000

[54] ADVERTISEMENT CARRIER

[76] Inventors: Frank Pollhaus; Uwe Pollhaus, both of Bahnofstr. 37, 58285 Gevelsberg; Jacek Kasperczyk, Stieglitzstr. 6, 42329 Wuppertal, all of Germany

[21] Appl. No.: 09/079,799

[22] Filed: May 15, 1998

[51] Int. Cl.[7] ..... G09F 27/00

[52] U.S. Cl. ..... 40/455; 40/334; 40/906

[58] Field of Search ..... 40/455, 717, 906, 40/124.03, 334

[56] References Cited

U.S. PATENT DOCUMENTS

| | | | |
|---|---|---|---|
| 2,791,417 | 5/1957 | Daroff | 40/455 X |
| 4,092,096 | 5/1978 | Goto | 431/253 |
| 4,382,687 | 5/1983 | Lemelson | 368/278 |
| 4,702,140 | 10/1987 | Goldfarb | 40/906 X |
| 5,365,686 | 11/1994 | Scott | 40/455 |
| 5,435,087 | 7/1995 | Karkar et al. | 40/564 |
| 5,574,519 | 11/1996 | Manico et al. | 40/455 X |
| 5,752,335 | 5/1998 | Shimogori et al. | 40/906 X |
| 5,841,878 | 11/1998 | Arnold et al. | 40/906 X |

*Primary Examiner*—Terry Lee Melius
*Assistant Examiner*—James M Hewitt
*Attorney, Agent, or Firm*—Friedrich Kueffner

[57] ABSTRACT

An article, of daily use such as a bottle opener, lighter, ball point pen, or the like, is configured as an advertisement carrier, wherein the article includes a housing portion on which an operational element of the article is mounted. The housing portion of the advertisement carrier is provided with an electrically operated device, such as a chip, which stores sound and/or speech, with a component for reproducing sound and/or speech, and with a release or tripping component for switching on the storage and/or reproducing devices.

33 Claims, 1 Drawing Sheet

FIG. 1
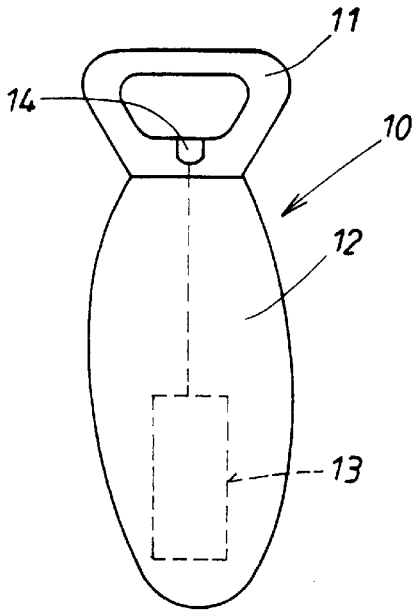
FIG. 2
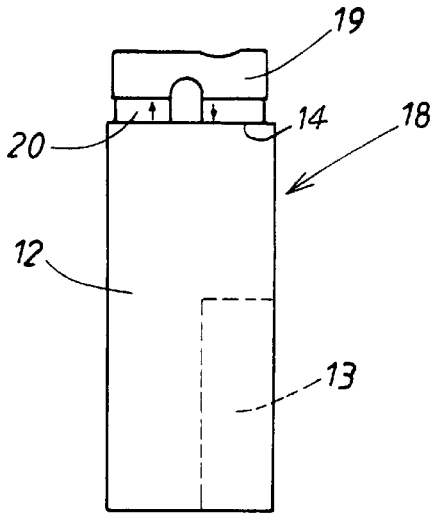
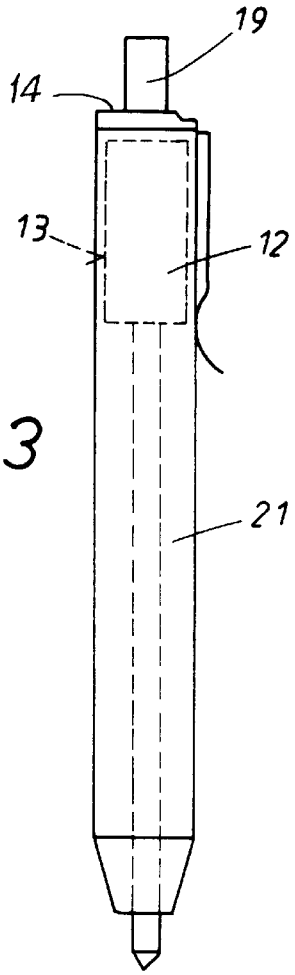
FIG. 3
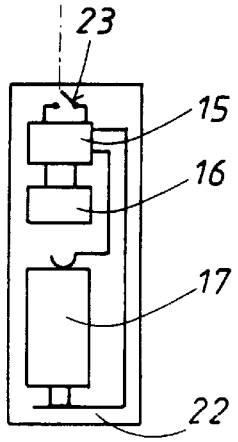
FIG. 4

ADVERTISEMENT CARRIER

BACKGROUND OF THE INVENTION

1. Field of the Invention

The present invention relates to a useful article, such as a bottle opener, lighter, ball point pen, or the like, configured as an advertisement carrier, wherein the article includes a housing portion on which an operational element of the article is mounted.

2. Description of the Related Art

Advertisement carriers of the above-described type include as an operational element either the actual bottle opener which is used for removing a cap from a bottle, a gas nozzle with an actuating member or an ink tube with actuating member of a ball point pen. Useful articles of this type are sold in a great variety and a large quantity, since they are used for advertisement purposes. For example, the name of the seller of the advertised article, his address or a certain product may be emphasized.

In the past, these articles had the disadvantage that the advertisements were always written onto the articles, so that the writing wore off after a longer use of the article and was no longer legible; moreover, after reading the advertisement several times, the user of the article became used to the advertisement and no longer recognized or observed the advertisement.

SUMMARY OF THE INVENTION

Therefore, it is the primary object of the present invention to construct an article of daily use as an advertisement carrier of the above-described type in which the advertisement is provided by sound.

In accordance with the present invention, the housing portion of the advertisement carrier is provided with an electrically operated device, such as a chip, which stores sound and/or speech, with a component for reproducing sound and/or speech, and with a release or tripping component for switching on the storage and/or reproducing devices.

The configuration according to the present invention makes it possible that an advertisement message is produced when the article is used by switching on the release component. The release component advantageously switches on when the advertisement carrier is used as intended. The seller of such an advertisement carrier ensures that the desired advertisement takes place each time the release component is actuated and that the advertisement is heard by the user. Such advertisement messages may also include brief information concerning the individual products.

In accordance with an advantageous feature, a battery is provided for current supply; consequently, the advertisement message can be played easily and simply. In accordance with a particular embodiment, provided for the current supply is a solar cell or another unit for producing current which stores current in a chargeable battery when exposed to light.

In accordance with an advantageous feature, the storage device and the reproducing component are arranged in a chamber of the housing in order to safely accommodate the individual structural components in this manner, and, on the other hand, to ensure that the use of the advertisement carrier is not impaired by these components. Advantageously, the current supply is mounted so as to be replaceable. It has been found advantageous in this connection if the storage unit and the reproducing unit are arranged on a plate because this ensures a simple assembly and, moreover, the units can be accommodated by simply pushing the plate into the chamber of the housing portion.

In accordance with a special embodiment of the invention, the release component can be activated through the actuating member of the advertisement carrier; in other words, each time a lighter or a ball point pen or the like is actuated, the advertisement message starts at a certain moment.

In accordance with another embodiment of the invention, the release component is an operational part of the advertisement carrier. This operational part, which may be provided, for example, on a bottle opener, activates the reproducing unit when the bottle opener is used and the cap of the bottle is opened.

In accordance with another advantageous feature, the advertisement message stored in the storage unit can be locked against cancellation in order to ensure that the advertisement carrier is always provided with the desired advertisement during the service life of the advertisement carrier.

In accordance with another advantageous feature, the storage unit is capable of playing a different advertisement message at each actuation of the advertisement carrier. As a result of this feature, the user of the article does not get used too much to the advertisement message, so that the useful article fully meets its purpose.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is a schematic illustration of a bottle opener;

FIG. 2 is a schematic illustration of a lighter;

FIG. 3 is a schematic illustration of a ball point pen; and

FIG. 4 is a schematic illustration of a plate provided with storage unit and reproducing unit.

DESCRIPTION OF THE PREFERRED EMBODIMENTS

The figures of the drawing show the individual components of the invention only in a schematical manner.

The bottle opener 10 shown in FIG. 1 has an opening portion 11 for opening a bottle. This opening portion is constructed in the known manner. The opening portion is provided on a housing portion 12 which is used for operating the bottle opener. The housing portion 12 is additionally provided with a chamber 13 in which the individual structural components, i.e., storage unit 15, reproducing unit 16, battery 17, are arranged.

The opening portion 11 is provided with a release part 14. When the bottle is opened, the cap of the bottle briefly presses against the release part, so that the storage unit, and particularly the reproducing part, are activated and the advertisement message is played.

In the embodiment according to FIG. 2, the lighter 18 has at its housing portion 12 also a chamber 13 in which the structural components are arranged. For actuating the lighter 18, an actuating member 19 is provided which in the conventional manner ignites the gas being discharged. In the position of rest, the actuating member 19 closes the gas nozzle 20.

When the actuating member 19 is moved, the reproducing device is once again activated so that the advertisement message is played.

In the embodiment according to FIG. 5, a ball point pen 21 includes an actuating member 19 which serves to push out the ink tube. Once again, when the actuating member 19 is actuated, the storage and reproducing device 15, 16 is activated, so that the advertisement message is being played.

FIG. 4 schematically illustrates how the individual components are mounted on a plate 22. This plate 22 is inserted into the chamber of the bottle opener, lighter or ball point pen. The storage unit constructed as a chip and mounted on the plate 22 is connected together with the reproducing part to a battery 17. When the actuating member or release part is activated, a switch 23 is briefly moved which activates the storage unit, so that the advertising message can take place. It is to be pointed out in this connection that the chip is a commercially available component which is capable of storing speech signals in an analog form and of reproducing speech when being activated.

As already mentioned, the embodiments illustrated in the drawing are only examples of realizing the invention. The invention is not limited to these embodiments; rather, various modifications and uses are possible. For example, instead of providing a chamber for receiving the structural components, it would also be possible to provide a support means that can be arranged on the side of the housing portion of the advertisement carrier. Moreover, the storage and reproducing unit according to the present invention can also be mounted in other types of advertisement carriers, so that a large variety of advertisement carriers with advertisement messages can be produced. In the case of the advertisement carrier constructed as a ball point pen, when the ball point pen is actuated, either the storage unit or the entire plate may be moved. The batteries may be mounted so as to be exchangeable. The chamber itself can be closed by a cover. Finally, in accordance with a special embodiment, the release member itself may be actuated for each advertisement message.

While specific embodiments of the invention have been shown and described in detail to illustrate the inventive principles, it will be understood that the invention may be embodied otherwise without departing from such principles.

We claim:

1. An advertisement carrier comprised of a bottle opener, with a housing portion comprising an operational element of the bottle opener, the housing portion further comprising an electrically operated storage device for storing sound and/or speech, a reproducing component for reproducing sound and/or speech, and a release component for switching on at least one of the storage device and the reproducing component.

2. The advertisement carrier according to claim 1, wherein the storage device is comprised of a chip.

3. The advertisement carrier according to claim 1, further comprising a battery for providing current supply.

4. The advertisement carrier according to claim 1, further comprising a solar cell for providing current supply.

5. The advertisement carrier according to claim 1, wherein the housing portion comprises a chamber, and wherein the storage device, and the reproducing component and a current supply means are arranged in the chamber.

6. The advertisement carrier according to claim 5, wherein the current supply means is mounted so as to be replaceable.

7. The advertisement carrier according to claim 1, wherein at least the storage device and the reproducing component are mounted on a plate.

8. The advertisement carrier according to claim 1, wherein the bottle opener comprises an actuating member for activating the release component.

9. The advertisement carrier according to claim 8, wherein the release component is formed by a surface of the bottle opener.

10. The advertisement carrier according to claim 1, wherein the storage device comprises means for preventing cancellation of an advertisement message stored in the storage unit.

11. The advertisement carrier according to claim 1, wherein the storage device contains a variety of advertisement messages, and wherein the release component is configured to play different advertisement messages upon each actuation of the reproducing component.

12. An advertisement carrier comprised of a lighter with a housing portion comprising an operational element of the lighter, the housing portion further comprising an electrically operated storage device for storing sound and/or speech, a reproducing component for reproducing sound and/or speech, and a release component for switching on at least one of the storage device and the reproducing component.

13. The advertisement carrier according to claim 12, wherein the storage device is comprised of a chip.

14. The advertisement carrier according to claim 12, further comprising a battery for providing current supply.

15. The advertisement carrier according to claim 12, further comprising a solar cell for providing current supply.

16. The advertisement carrier according to claim 12, wherein the housing portion comprises a chamber, and wherein the storage device, the reproducing component and a current supply means are arranged in the chamber.

17. The advertisement carrier according to claim 12, wherein the current supply means is mounted so as to be replaceable.

18. The advertisement carrier according to claim 12, wherein at least the storage device and the reproducing component are mounted on a plate.

19. The advertisement carrier according to claim 12, wherein the lighter comprises an actuating member for activating the release component.

20. The advertisement carrier according to claim 19, wherein the release component is formed by a surface of the lighter.

21. The advertisement carrier according to claim 12, wherein the storage device comprises means for preventing cancellation of an advertisement message stored in the storage unit.

22. The advertisement carrier according to claim 12, wherein the storage device contains a variety of advertisement messages, and wherein the release component is configured to play different advertisement messages upon each actuation of the reproducing component.

23. An advertisement carrier comprised of a ball point pen with a housing portion comprising an operational element of the ball point pen, the housing portion further comprising an electrically operated storage device for storing sound and/or speech, a reproducing component for reproducing sound and/or speech, and a release component for switching on at least one of the storage device and the reproducing component.

24. The advertisement carrier according to claim 23, wherein the storage device is comprised of a chip.

25. The advertisement carrier according to claim 23, further comprising a battery for providing current supply.

26. The advertisement carrier according to claim 23, further comprising a solar cell for providing current supply.

27. The advertisement carrier according to claim 23, wherein the housing portion comprises a chamber, and wherein the storage device, the reproducing component and a current supply means are arranged in the chamber.

28. The advertisement carrier according to claim 23, wherein the current supply means is mounted so as to be replaceable.

29. The advertisement carrier according to claim 23, wherein at least the storage device and the reproducing component are mounted on a plate.

30. The advertisement carrier according to claim 23, wherein the ball point pen comprises an actuating member for activating the release component.

31. The advertisement carrier according to claim 30, wherein the release component is formed by a surface of the ball point pen.

32. The advertisement carrier according to claim 23, wherein the storage unit comprises means for preventing cancellation of an advertisement message stored in the storage unit.

33. The advertisement carrier according to claim 12, wherein the storage device contains a variety of advertisement messages, and wherein the release component is configured to play different advertisement messages upon each actuation of the reproducing component.

* * * * *